US006196907B1

(12) United States Patent
Kahn

(10) Patent No.: US 6,196,907 B1
(45) Date of Patent: Mar. 6, 2001

(54) SLURRY DELIVERY SYSTEM FOR A METAL POLISHER

(75) Inventor: Stephen S. Kahn, Northport, NY (US)

(73) Assignee: U.S. Dynamics Corporation, Amityville, NY (US)

( * ) Notice: Subject to any disclaimer, the term of this patent is extended or adjusted under 35 U.S.C. 154(b) by 0 days.

(21) Appl. No.: 09/410,624

(22) Filed: Oct. 1, 1999

(51) Int. Cl.[7] ..... B24B 57/00

(52) U.S. Cl. ..... 451/446; 457/262; 457/269; 457/291; 457/60

(58) Field of Search ..... 457/60, 446, 282, 457/288, 289, 285, 291

(56) References Cited

U.S. PATENT DOCUMENTS

| | | | | |
|---|---|---|---|---|
| 3,848,366 | * | 11/1974 | David | 451/262 |
| 4,048,763 | * | 9/1977 | Janssen | 451/262 |
| 4,272,924 | * | 6/1981 | Masuko et al. | 451/269 |
| 4,433,510 | * | 2/1984 | Katagiri et al. | 451/269 |
| 4,490,948 | * | 1/1985 | Hanstein et al. | 451/262 |
| 4,502,252 | * | 3/1985 | Iwabuchi | 451/291 |
| 4,674,236 | | 6/1987 | Kawakami et al. . | |
| 4,845,816 | | 7/1989 | Nanis . | |
| 4,930,259 | | 6/1990 | Kobylenski et al. . | |
| 5,533,923 | | 7/1996 | Shamouilian et al. . | |
| 5,554,064 | * | 9/1996 | Breivogel et al. | 451/41 |
| 5,582,540 | | 12/1996 | Su et al. . | |
| 5,658,185 | * | 8/1997 | Morgan, III et al. | 451/36 |
| 5,779,525 | * | 7/1998 | Boller | 451/262 |
| 5,816,900 | | 10/1998 | Nagahara et al. . | |
| 5,876,271 | * | 3/1999 | Oliver | 451/60 |
| 6,045,437 | * | 4/2000 | Tandon et al. | 451/288 |

* cited by examiner

*Primary Examiner*—David A. Scherbel
*Assistant Examiner*—George Nguyen
(74) *Attorney, Agent, or Firm*—Collard & Roe, P.C.

(57) ABSTRACT

A slurry delivery system for use with a polishing machine wherein the slurry delivery system is designed to reduce the incidence of oxidized metals or rust from flowing into a slurry compound used to polish substrates used in the manufacture of disk drives. The slurry delivery system comprises an extended drive shaft made from type 416 stainless steel having a longitudinally extending inner channel Inside of this inner channel is a type 316 slurry feed tube that is used to shield the type 416 stainless steel from a slurry containing corrosive de-ionized water. The drive shaft has a first end connected to a drive motor and a second distal end. Connected to the second distal end is a type 316 stainless steel hub. The hub is surrounded by a urethane slurry distribution plate that has channels cut for allowing slurry to flow. This slurry flows onto a urethane slurry isolation pad and through slurry distribution tubes mounted in holes in the platen and onto the surface of nickel plated substrates used to manufacture hard disk drives.

16 Claims, 13 Drawing Sheets

SLURRY DELIVERY SYSTEM FOR A METAL POLISHER

BACKGROUND OF THE INVENTION

1. Field of the Invention

The invention relates to an improved polishing slurry delivery system for polishing electroless nickel plating used to manufacture hard disk drives. This slurry delivery system is for use with Wittig style machines 2. Description of the Prior Art Polishing machines for polishing disk drives are known in the art. For example, U.S. Pat. No. 4,930,259 to Kobylenski et al. discloses a Magnetic Disk Substrate Polishing Assembly. In this case, the polishing assembly comprises a polish roller having a continuously fed polish cloth or polish tape. In addition, U.S. Pat. No. 4,845,816 to Nanis discloses a burnishing head for burnishing memory surfaces of computer memory disks.

With regard to the field of the present invention, Seagate Recording Media in Anaheim, California manufactures computer hard drives using a Wittig Polisher. Hans Wittig, of Seagate developed a polisher that is used to planorize or make flat, and polish electroless nickel plating which has been deposited on aluminum substrates This polishing process can be accomplished in two steps. Step one uses a very aggressive polishing process to planorize the nickel plating. Step two involves a less aggressive polishing technique that polishes the nickel to a mirror finish. The resultant substrate has a surface that is flat to within a few millionths of an inch, and has virtually no scratches when viewed with a laser inspection machines. The polishing media is a slurry of very fine aluminum oxide, each particle being less than 0.1 micron in size, and de-ionized water. De-ionized water is corrosive to ferric metals, and will thus cause rapid oxidation to most iron carrying metals.

The Wittig design has one problem in that the slurry and the de-ionized water must travel through more than a total of 20 feet of iron carrying metals per machine to reach the substrate surface. This results in iron oxide (rust) being mixed with the fine slurry and de-ionized water. Since the particles of rust can be several orders of magnitude larger than the very fine particles of the aluminum oxide polishing compound, the rust causes unacceptable scratches in the surface of the substrates.

SUMMARY OF THE INVENTION

It is therefore, an object of the invention to provide a slurry delivery system for a Wittig type polishing machine that can be assembled into a Wittig machine with little adjustment.

It is another an object of the invention to provide a slurry delivery system for a Wittig type polishing machine that reduces the exposure of de-ionized water and slurry to ferrous metals.

It is a further object of the invention to provide a slurry delivery system for a Wittig type polishing machine that reduces the amount of oxide impurities in an applied slurry.

It is still a further object of the invention to provide a slurry delivery system for a Wittig type polishing machine that improves the polishing surface of disk drives and thus reduces the failure rate of disk drives to below 10%.

These and other objects are achieved by providing a slurry delivery system for a Wittig machine comprising an extended length drive shaft made from type 416 stainless steel having a longitudinally extended inner channel. The heat treated type 416 stainless steel drive shaft provides the rugged high strength bearing journals required for this Wittig machine element. The relatively high tensile strength of the type 416 stainless steel will allow for long drive shaft life and improved durability. Type 416 stainless steel is a martensitic stainless steel containing 12–14% chromium as an alloying agent. Because stainless steels derive their resistance to corrosion from the presence of chromium, increasing the chromium content in steel progressively enhances the resistance to rusting. There is a slurry delivery tube made from type 316 stainless steel disposed within the drive shaft. Type 316 stainless steel has a chromium content of about 16–18% that is noticeably higher than type 416 stainless steel. In addition, type 316 stainless steel contains between 10–14% nickel which can be used to greatly improve the delivery tubels resistance to nonoxygenating media such as the abrasive slurry. Type 316 stainless steel also contains a higher level of manganese, which does not alter the corrosion resistance of the chromium, and molybdenum that improves resistance to solutions of halogen salts and pitting in seawater. Thus, this slurry delivery tube is less prone to corrosion than the type 416 stainless steel used for the drive shaft. In this way, the slurry delivery tube contained within the drive shaft eliminates the possibility that de-ionized water will contact and oxidize any iron based metal.

The de-ionized water is fed through a type 316 stainless steel slurry delivery tube in the central core of the drive shaft, which attaches to a type 316 stainless steel cross tube, within the drive shaft, that connects to a suitable manifold assembly that is inert to de-ionized water. The slurry leaves the manifold and continues through a modified slurry bowl and U-Joint to the type 316 stainless steel hub. After the de-ionized water and slurry passes through the hub -t flows into a large urethane plate attached to the upper Meehanite Platen. The slurry and de-ionized water flows through this urethane plate and down into type 316 stainless steel delivery tubes inserted into the Meehanite Upper Platen. A thin urethane pad with adhesive backing isolates the slurry from the top surface of the Meehanite Upper Platen.

This new design mimics the spring rate and stiffness of the current platen support so as not to introduce any unknown variables that could effect the polishing process.

Thus, this type design provides a corrosion free path for the transition of slurry, de-ionized water, and air to the substrate surfaces. In this case, the entire tool upgrade can be delivered on site and installed reasonably quickly in a Wittig type polishing machine resulting in minimum tool downtime. This design provides a complete low cost, long term effective solution for Wittig serviceability for a long time.

BRIEF DESCRIPTION OF THE DRAWINGS

Other objects and features of the present invention will become apparent from the following detailed description considered in connection with the accompanying drawings that disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
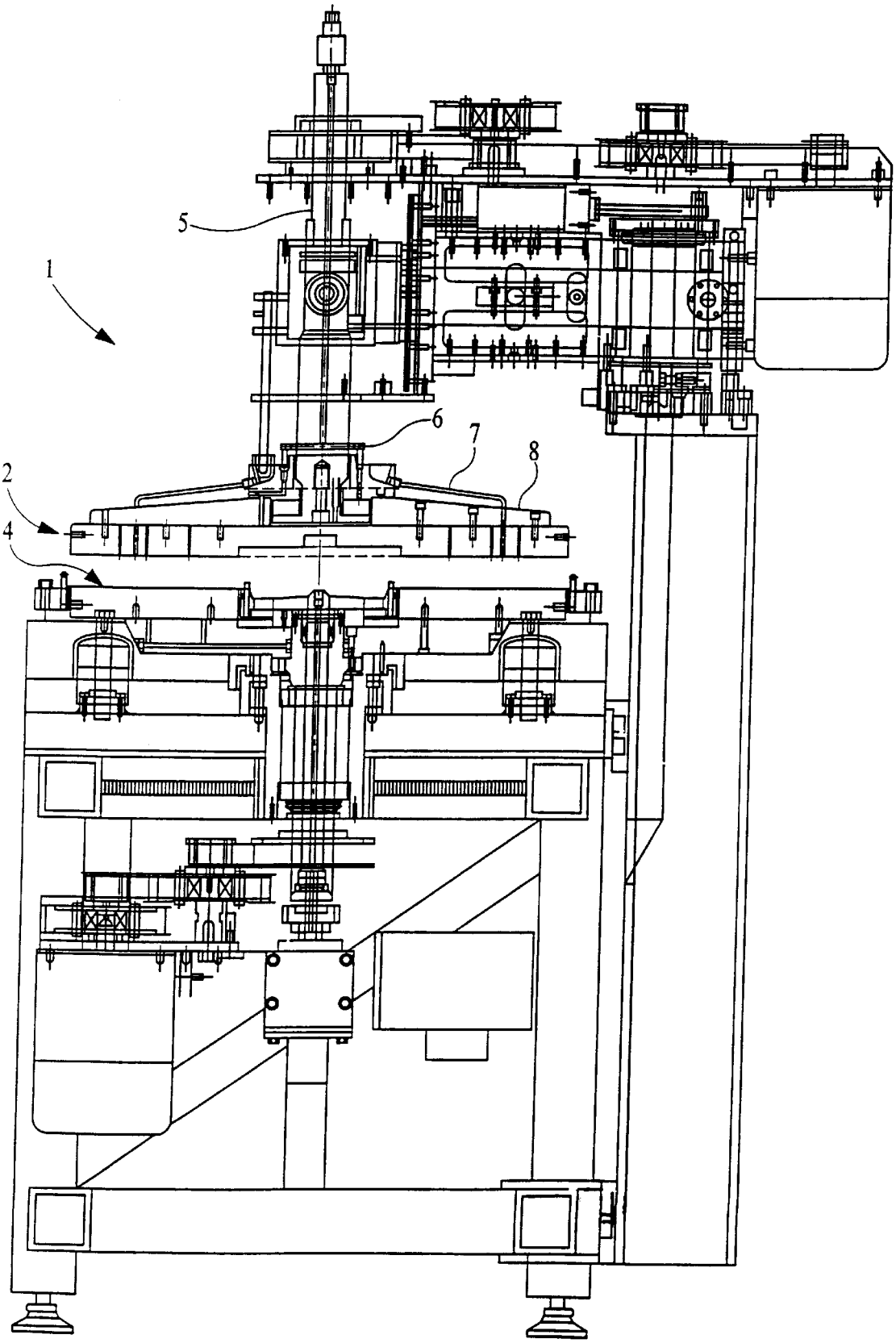
FIG. 1 is a cross sectional view of the prior art showing a Wittig machine for polishing disk drives.

Referring to the drawings, FIG. 1 shows a cross-sectional view of a prior art representation of a Wittig machine 1. Wittig machine 1 is used to polish nickel plated aluminum substrates in hard disk drives. Wittig machine 1 contains an upper platen 2, and a lower platen 4. When polishing nickel plated substrates for hard disk drives, both upper platen 2 and lower platen 4 are driven in a circular motion and are independent of each other. The upper platen often rotates in the opposite direction from that of the lower platen. Upper platen 2 includes a slurry delivery system that delivers slurry through the platen to polish these substrates. In FIG. 1 the slurry passes through drive shaft 5 made from 8620 steel, through internal holes in the 8620 steel drive shaft 6, through tubing 7 and on into the upper platen support 8 and upper platen 2. Both the upper platen support 8 and upper platen 2 are made from Meehanite cast iron. Meehanite cast iron has a substantially uniform grain structure which gives top platen 2 uniform thermal expansion. This uniform thermal expansion is necessary to keep upper platen 2 from deforming when polishing substrates.

However, since the 8620 drive shaft, the upper platen 2, the upper platen support 8, are made from materials containing huge amounts of iron, the slurry, and de-ionized water will rapidly oxidize the iron and create rust impurities within the system.

Figure 2:
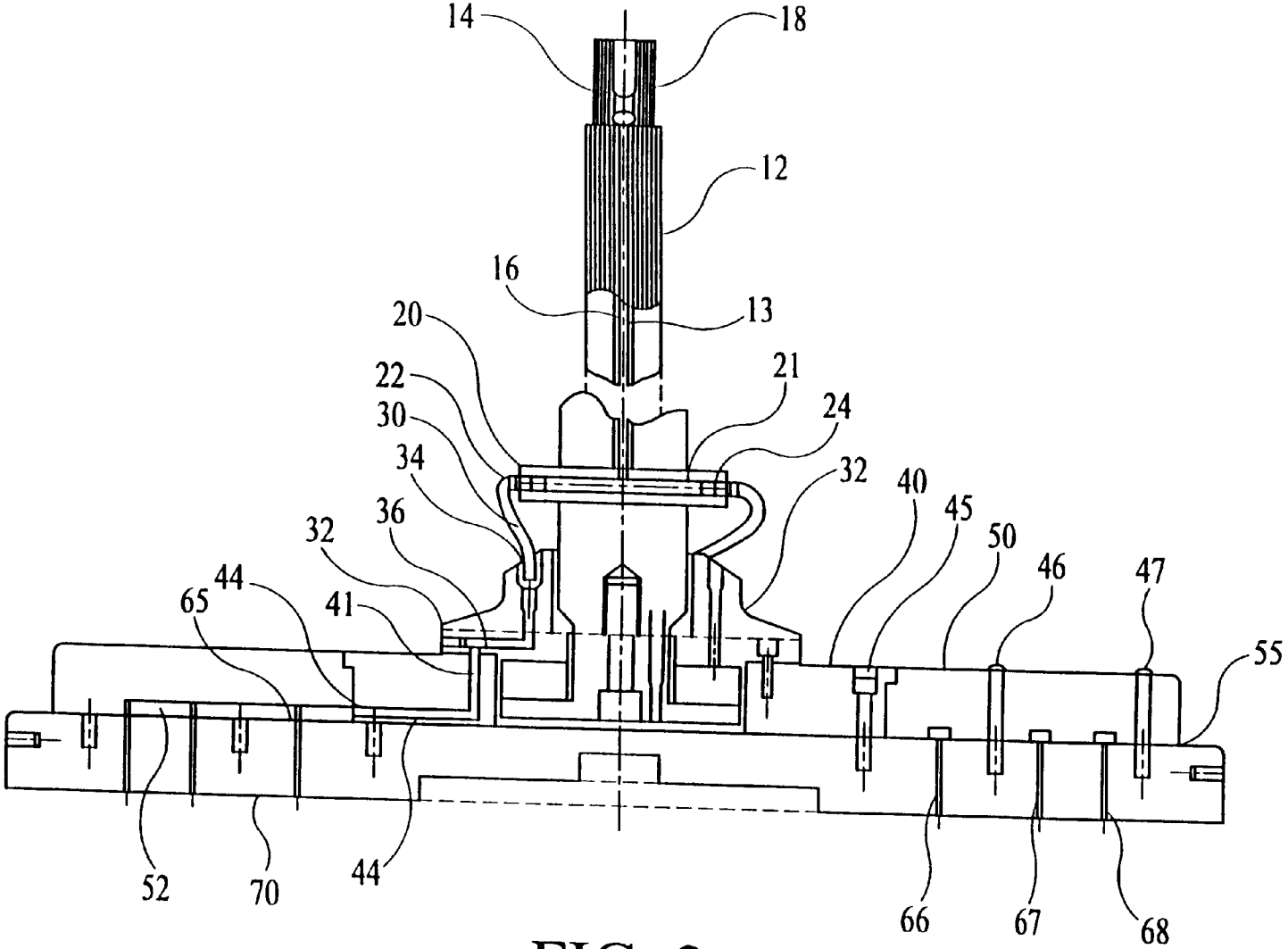
FIG. 2 is a cross sectional view of a first embodiment of the invention wherein the slurry distribution tubes are disposed adjacent to the drive shaft.
Figure 3:
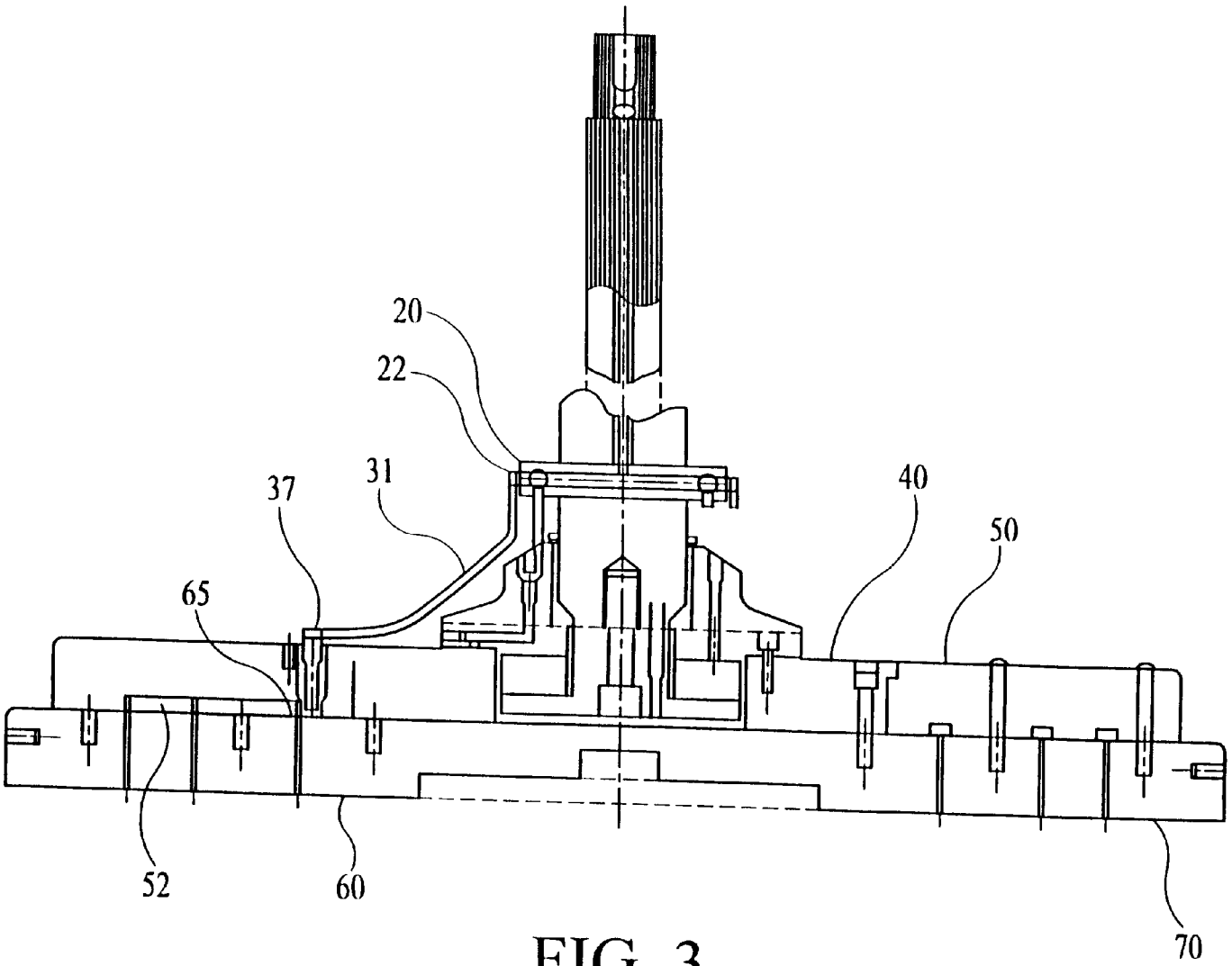
FIG. 3 is a cross-sectional view of a second embodiment of the invention wherein the slurry distribution tubes are connected to a cross feed supply.

The invention as shown in FIGS. 2 and 3 is an improvement on this slurry delivery system that eliminates the contact between ferrous metals and the slurry that contains de-ionized water. In FIG. 2, the new slurry delivery system, consisting of a type 416 stainless steel extended length drive shaft, type 316 stainless steel central core and cross feed, suitable manifold inert to the slurry, type 316 stainless steel hub, urethane slurry delivery plate, type 316 stainless steel slurry delivery tubes with laser welded head, and a urethane isolation pad, is used to replace the original assembly shown in FIG. 10. The slurry delivery system shown in FIG. 2 is an improvement over the prior art of FIG. 1 since the slurry consisting of a very fine aluminum oxide and de-ionized water flows through the system from its introduction to the input of the polishing machine through the entire path to the surface of the aluminum substrates while only contacting components made from type 316 stainless steel and urethane, both inert to the slurry mixture. This new corrosion free path absolutely prevents the possibility of the slurry coming into contact with any ferrous materials and eliminates the formation of rust that will cause unacceptable scratches on the surface of the nickel plated aluminum substrates.

The prior art of FIG. 1 allows the slurry mixture to travel through more than 20 feet of passageways containing iron that will rapidly produce rust in the presence of the slurry.

In FIG. 2, shows a cross-sectional view of the slurry delivery system that is designed to substitute for the prior art of the Wittig machine shown in FIG. 1. This slurry delivery system contains an extended length stainless steel drive shaft 12 made from type 416 stainless steel. Inside of this drive shaft is an elongated channel 13. At a top end of drive shaft 12 are two type 316 stainless steel socket screws 14 and a type 316 slurry feed tube 160 At an opposite end, a cross feed supply 20 made from type 316 stainless steel is connected to tube 16 within drive shaft 12 via a bushing not shown. Slurry flows through tube 16 and feeds into channel 21 on cross feed supply 20. Fittings, 22, are inserted into cross feed supply 20 and are used to connect to slurry distribution tubes 30 to the modified slurry bowl 32 via joint 34. The slurry next flows through channel 36 in the U-Joint and on into hub 40. Hub 40 is manufactured from type 316 stainless steel and extends around drive shaft 12 in a ring. Hub 40 connects and secures to Meehanite Platen 60 via socket head cap screws 45. Disposed between hub 40 and Meehanite platen 60 is a urethane slurry distribution pad 55 that shields Meehanite platen 60 from slurry and de-ionized water.

Urethane slurry distribution plate 50 surrounds hub 40 and is secured to Meehanite platen via screws 46 and 47. With this assembly, slurry flows through channel 36 down through drill hole 41 and out through channels 44. Next the slurry and de-ionized water flows into slot 52 contained between urethane plate 50 and urethane pad 55 disposed on Meehanite platen 60. In addition, a series of stainless steel slurry delivery tubes 65 are inserted into holes 57 58 and 59 within urethane pad 55 and into holes 66, 67, and 68 within Meehanite platen 60. These stainless steel delivery tubes 65 are used to deliver the slurry through holes within Meehanite platen 60 to a series of nickel plated aluminum substrates.

Figure 11:
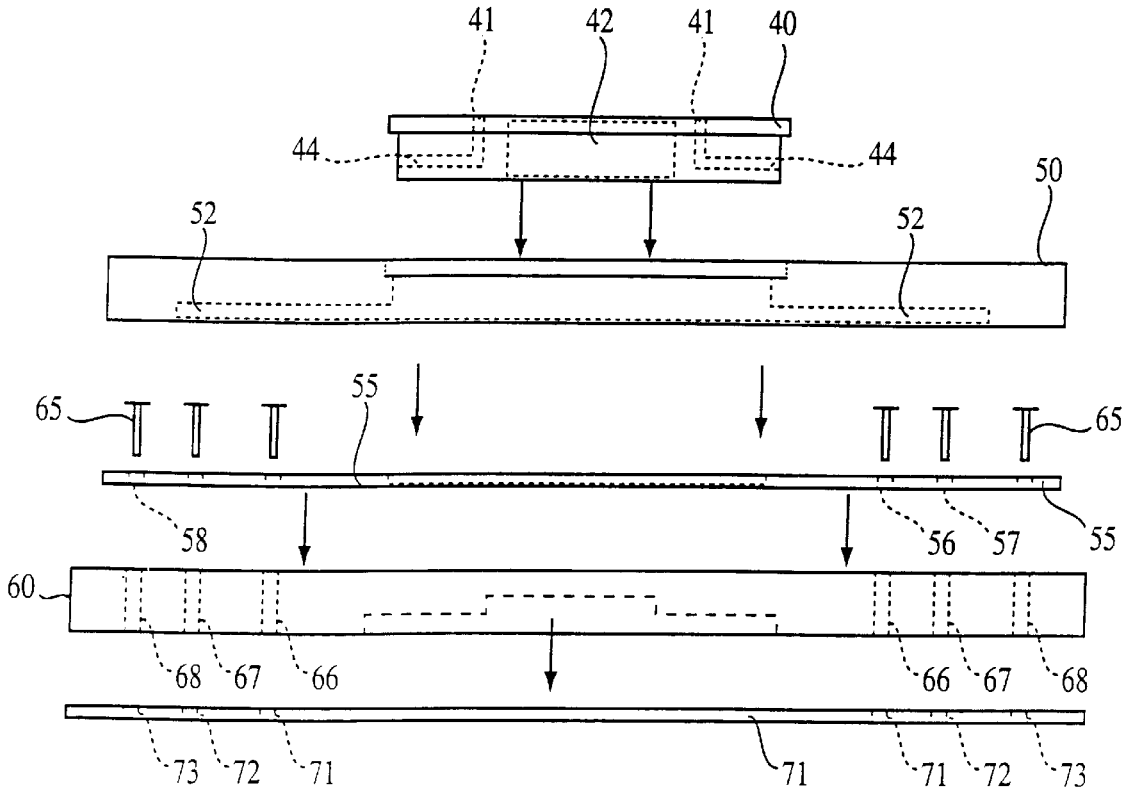
FIG. 11 is an exploded view of the slurry delivery system.

FIG. 3 shows a cross-sectional view of a second embodiment of the invention. In this embodiment, fitting 22 is threaded to the ends of cross feed supply 20 and coupled to a second type plastic slurry distribution tube 310 The other end of tube 31 is connected to a second fitting 37, mounted on urethane distribution plate 50. This connection allows slurry to flow through plastic distribution tubes 31, through type 316 stainless steel fittings 37, directly into channels 52 in urethane plate 50, and down through stainless steel delivery tubes 65 disposed within Meehanite platen 60. The slurry next flows out of polishing pad 70 (as shown in FIG. 11.) and on to the nickel plated aluminum substrates. With this second embodiment, the slurry follows an alternative shorter path outside of hub 40, avoiding much of the internal components shown in FIG. 2.

Figure 4:
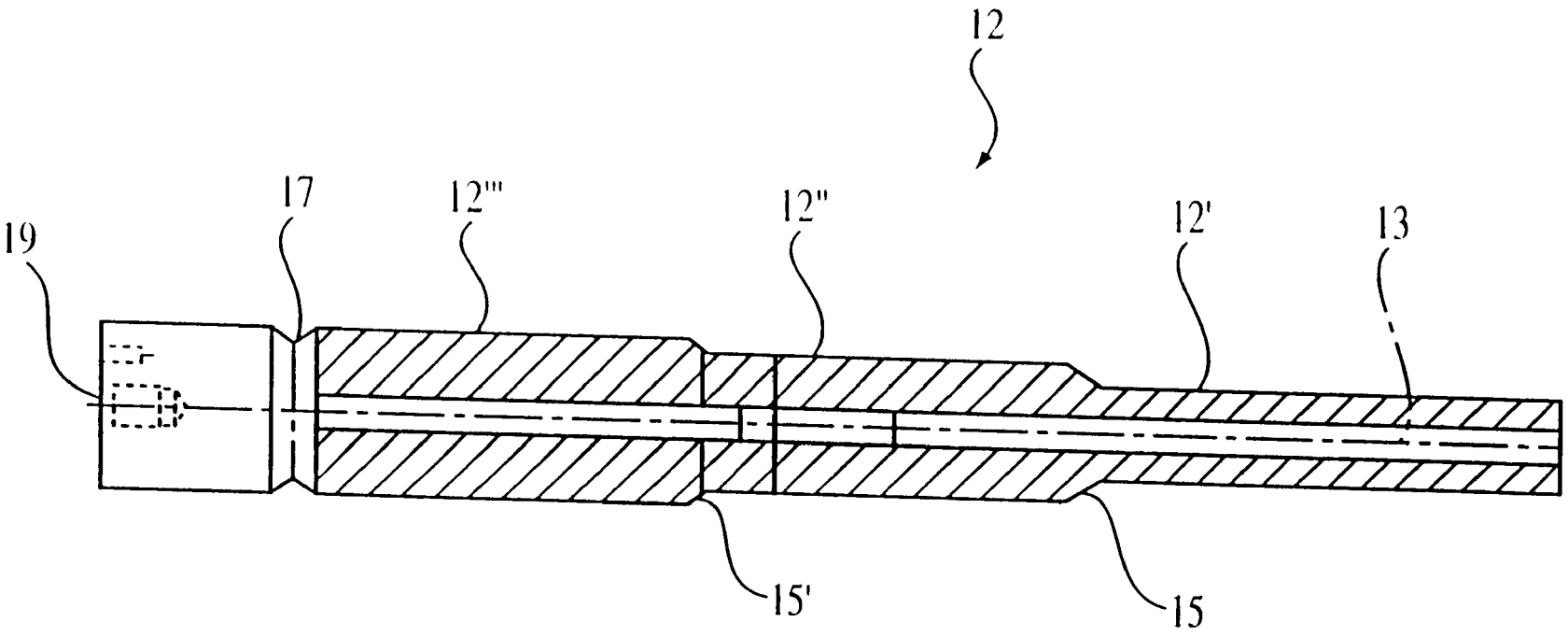
FIG. 4 is a cross-sectional view of an extended length drive shaft.

FIG. 4 shows a cross-sectional view of elongated type 416 stainless steel drive shaft 12. In this view, inner channel 13 is shown extending longitudinally through drive shaft 12. In addition, drive shaft 12 expands incrementally at expansion points 15 and 15' to define three stages of the shaft, namely 12', 12" and 12" with each stage having a successively larger diameter. At the bottom end is cross channel 17 that intersects inner channel 13 perpendicularly. Cross channel 17 houses cross feed 20. Finally, at the bottom end of shaft 12 is a threaded hole 19 designed to receive a high strength cap screw for attaching drive shaft 12 to the remainder of the lower platen.

Figure 5A:
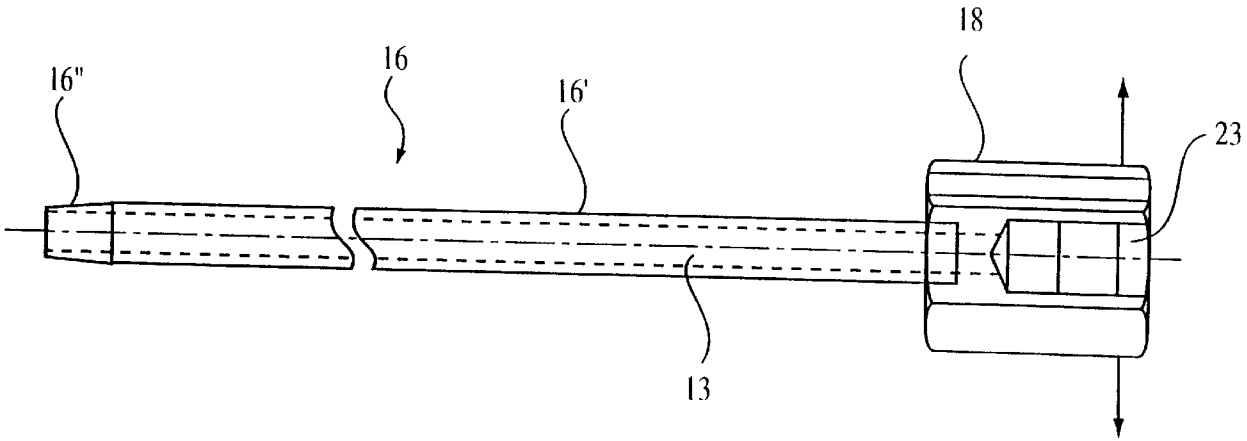
FIG. 5*a* is a side view of the stainless steel supply tube.
Figure 5B:
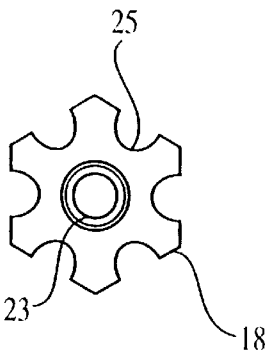
FIG. 5*b* is an end view of the coupling for the supply tube.

FIG. 5*a* shows a side view of type 316 stainless steel slurry feed tube 16 having a tube body 16' attached to a connecting hub 18. Hub 18 has an inner channel 23 that is in communication with inner channel 13 in tube 16'. In addition, as shown in FIG. 5*b* hub 18 is beveled with bevel points 25 so that it can receive socket screws 14 (FIG. 2) which are used to stop hub 18 from turning once feed tube 16 is inserted into drive shaft 12. Slurry feed tube 16; having type 316 stainless steel, shields shaft 12, having type 416 stainless steel, from the corrosive effects of the slurry and de-ionized water. Tube 16 feeds into the center hole 23 of cross feed supply tube 20 shown in FIG. 6*a*. Tube 16 may include a threaded tip 16" to thread into hole 23 of tube 20.

Figure 6A:
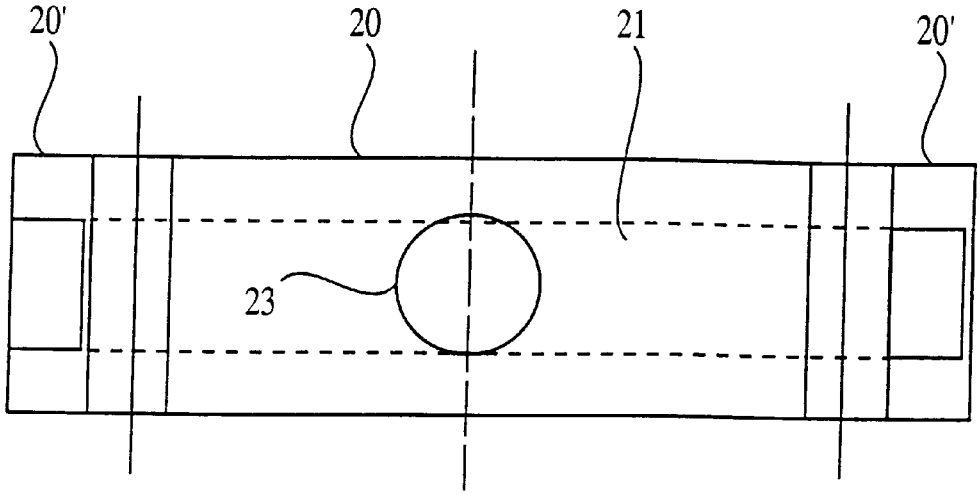
FIG. 6*a* is a side view of a cross feed supply.

FIG. 6*a* shows a cross sectional view of cross feed supply tube 20 which is disposed within elongated stainless steel drive shaft 12 at opening 17. Cross feed supply tube 20 is disposed perpendicular to elongated channel 13 and its ends 20' past the surface of stainless steel drive shaft 12. The bore at each tube end 20' is preferably threaded so as to engage a threaded nipple having multiple openings 22. Flexible tubes 30 can then be coupled to these nipples to conduct the fluid through the slurry bowl 32.

Figure 6B:
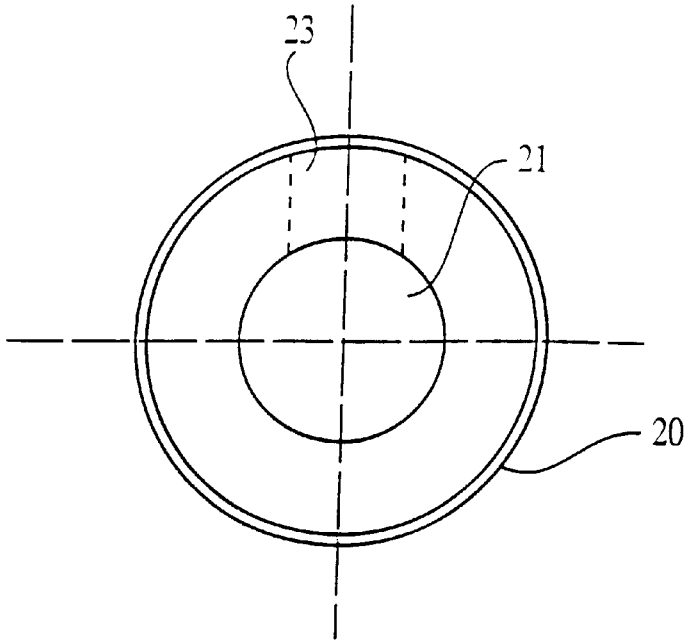
FIG. 6*b* is a cross sectional view of the cross feed supply.

Tube 20 contains a cross feed inner channel 21 that is connected at its center with channel 13 so that it receives a flow of slurry from inner channel 13 FIG. 6*b* is an end view of the cross feed supply tube 20 which is designed to have an outer diameter that is slightly smaller than shaft opening 17 so that tube 20 fits snugly within shaft 12.

Figure 7A:
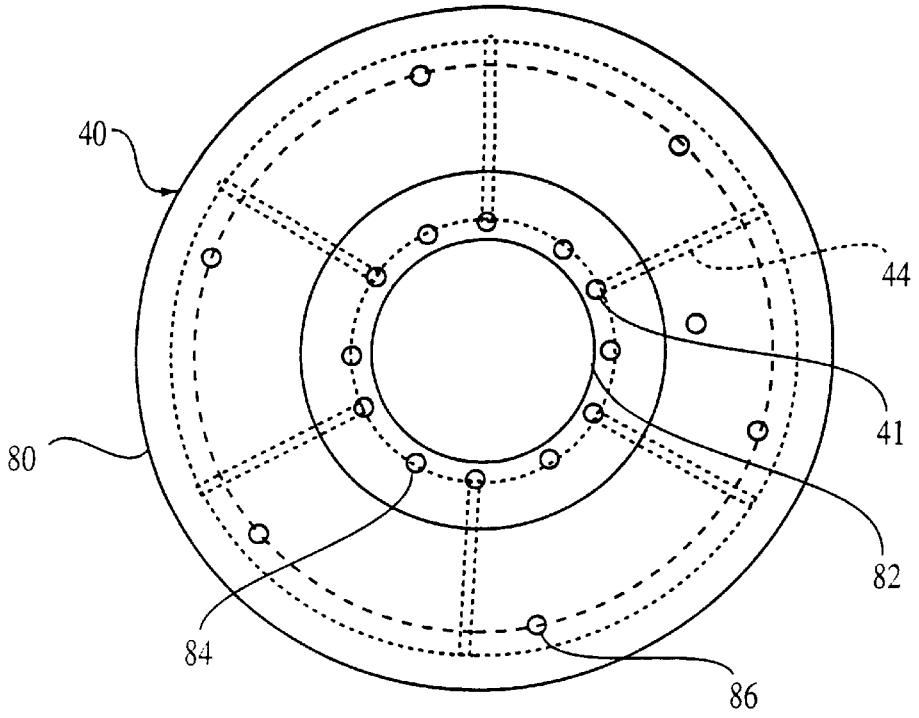
FIG. 7*a* is a top view of a stainless steel hub.

FIG. 7*a* shows a top view of type 316 stainless steel hub 40 having an outer circumference 80, and an inner circumference 82. Spaced along hub 40 adjacent to inner circumference 82 are a series of drill holes 41 designed to allow slurry and de-ionized water to flow from channel 36 through drill hole 41 and out through channel 44. In addition, drill holes 84, which are not associated with drill holes 41, are designed to receive a series of head cap screws 43. (FIG. 2). Furthermore, drill holes 86, disposed adjacent to outer circumference 80 are used to receive head cap screws 45, wherein screws 43 and 45 are designed to secure hub 40 to Meehanite platen 60.

Figure 7B:
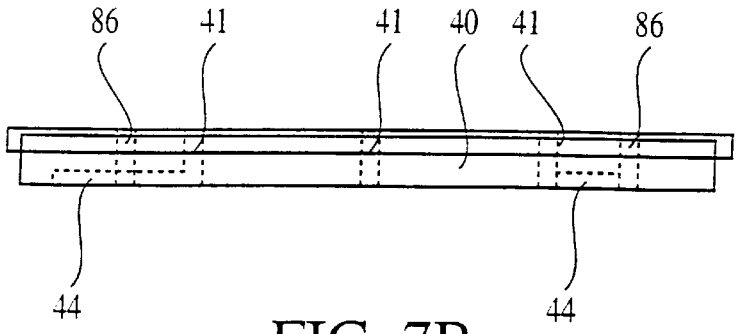
FIG. 7*b* is a side view of the stainless steel hub.
Figure 7C:
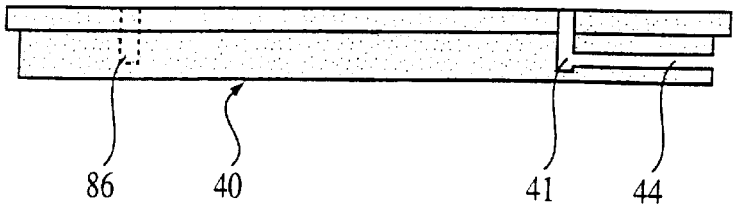
FIG. 7*c* is a cross sectional view of the stainless steel hub.

FIGS. 7*b* and 7*c* show alternative views of hub 40 taken along its cross section. FIG. 7*b* is an end view of hub 40 showing drill holes 84 and 86 via dashed dotted lines, and channels 44.

FIG. 7*c* is a cross sectional view of hub 40 showing hole 41 and channel 44. Channel 44 connects with channel 52 of urethane plate 50 to allow slurry to flow into channel 52 of plate 50.

Figure 8A:
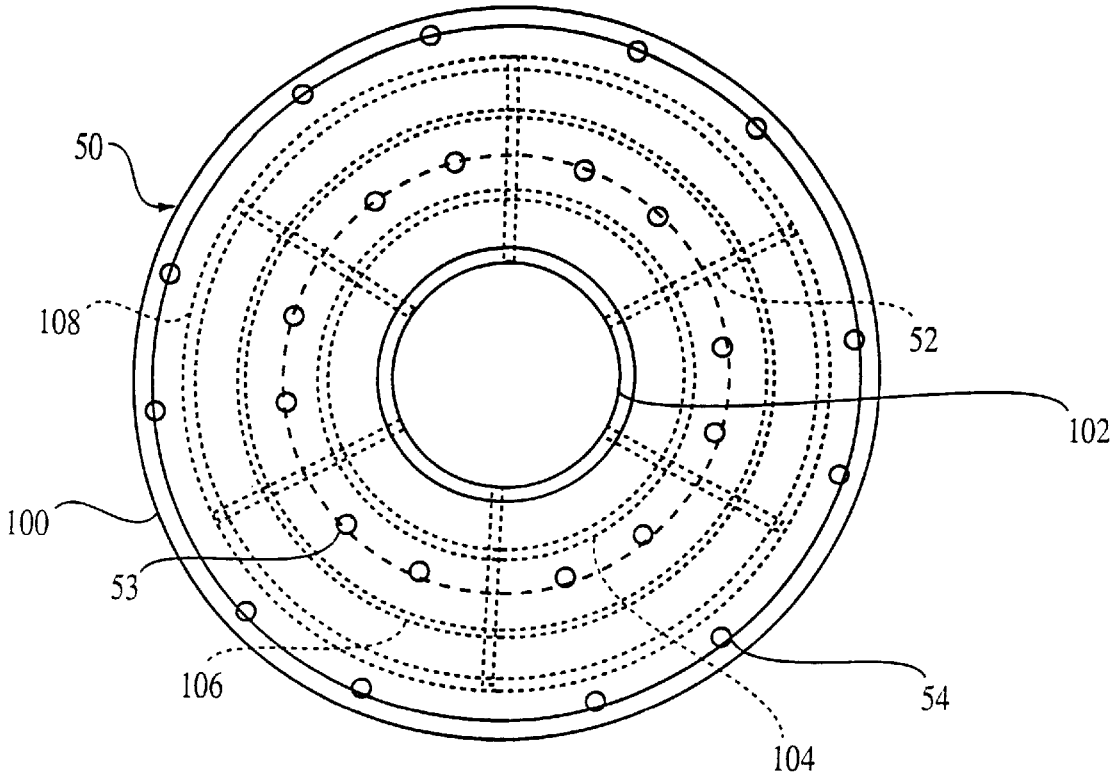
FIG. 8*a* is a top end view of the urethane slurry distribution plate.
Figure 8B:
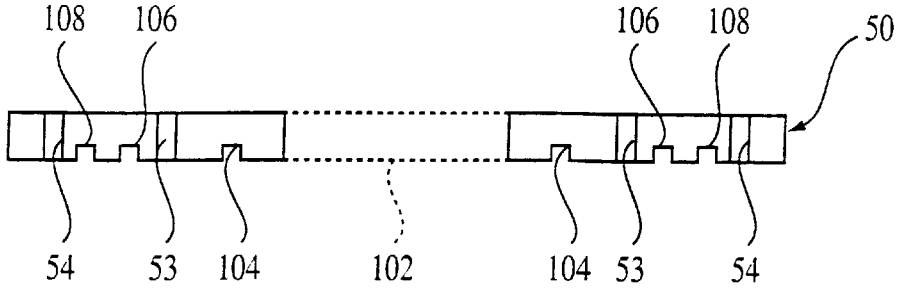
FIG. 8*b* is a cross-sectional side view of the urethane slurry distribution plate.

FIG. 8*a* is a top view of a urethane slurry distribution plate 50 having an outer circumference 100 and an inner circumference 102. In addition; within distribution plate 50 are a series of bore holes 53 and 54 (FIG. 8*b*) in concentric rings with bore holes 53 adjacent to inner diameter 102 and bore holes 54 adjacent to outer diameter 100. As shown in FIGS. 2 and 3, each bore hole 53 is designed to receive a screw 46 while each bore hole 54 is designed to receive a screw 47.

Figure 8C:
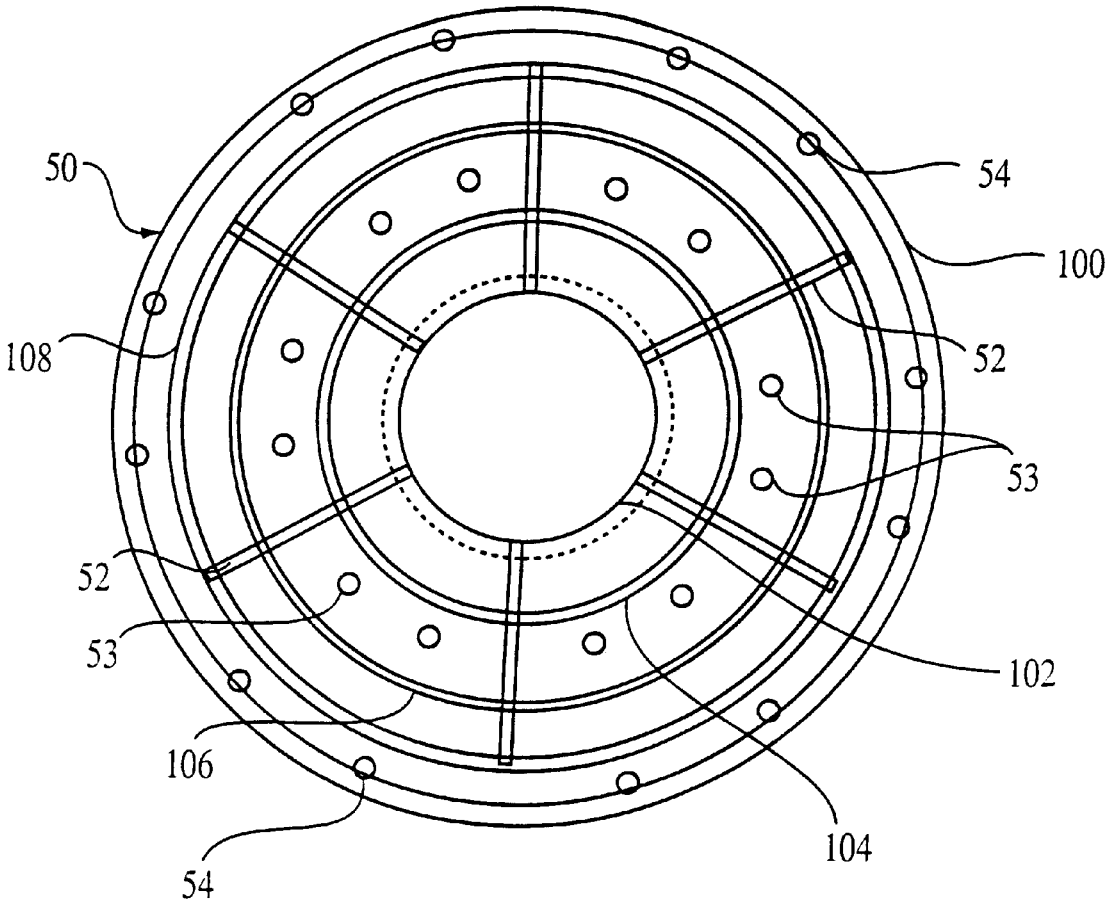
FIG. 8*c* is a the bottom end view of the urethane slurry distribution plate.

FIG. 8*c* shows a bottom view of urethane slurry distribution plate 50 having a series of concentric tracks 104, 106 and 108 for conveying slurry around plate 50 received from six radially extending channels 52. Channels 52 extend radially outwardly from inner diameter 102 so that the slurry will flow into a series of holes 66, 67 and 68 each forming a circumferential ring on Meehanite platen in FIG. 2. In this way, this series of drill holes or channels 41, 44, 52 and 66, 67 and 68 and 104, 106 and 108 allows for a uniform distribution of slurry while eliminating the contact of slurry with any ferrous materials.

Figure 9:
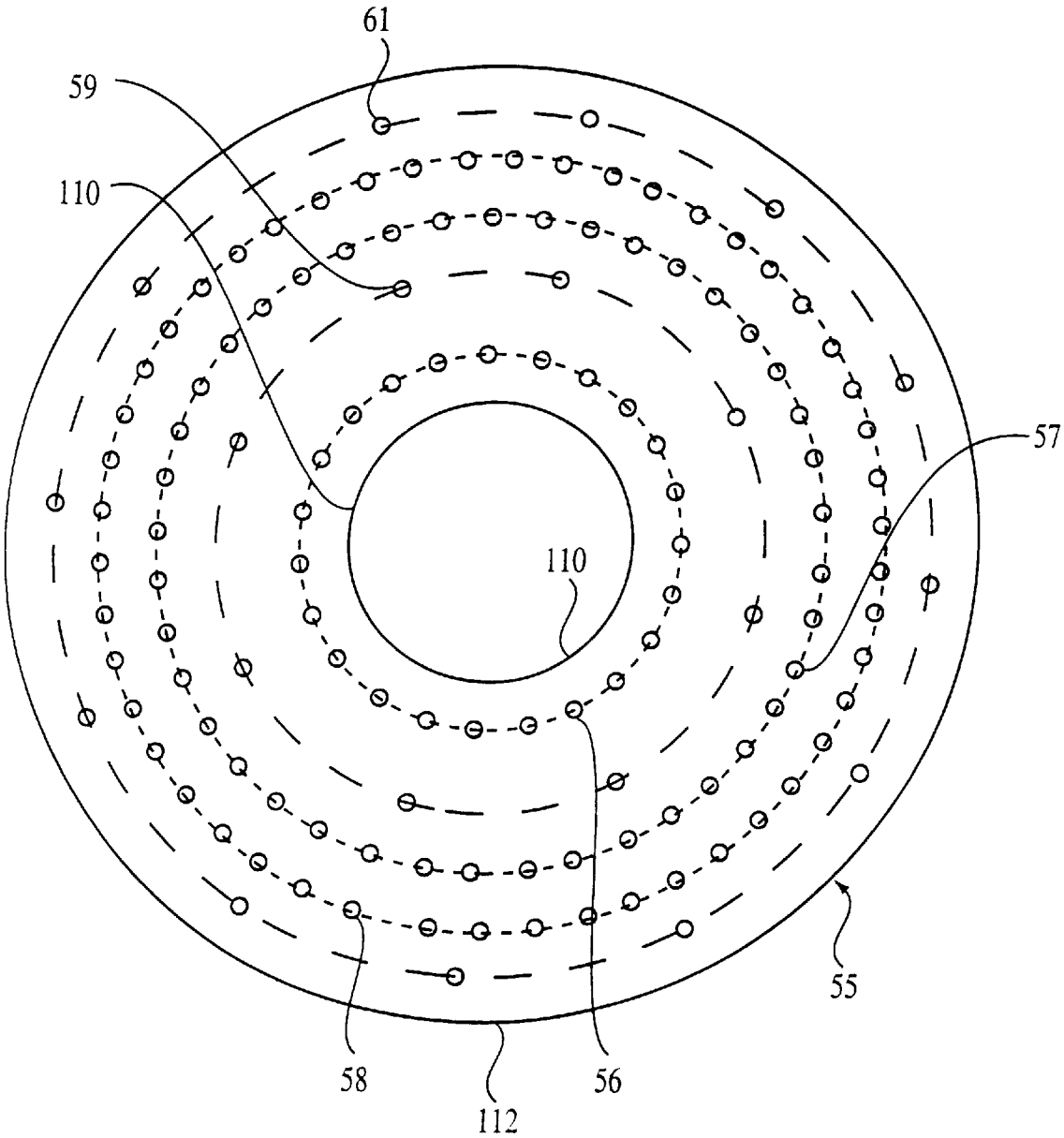
FIG. 9 is bottom view of a urethane slurry isolation pad.

FIG. 9 shows a top view of urethane slurry isolation pad 55 having an inner diameter 110 and an outer diameter 112. Disposed within isolation pad 55 are a series of bore holes 56, 57 and 58 designed to receive a slurry delivery tube 65. There are also a second series of bore holes 59 and 61 each designed to receive screws 45 and 47. As shown in FIGS. 2 and 3 urethane slurry isolation pad 55 is disposed between urethane slurry distribution plate 50 and Meehanite platen 60. In this case, urethane slurry isolation pad 55 attaches to Meehanite platen 60 with a sticky back adhesive.

Figure 10A:
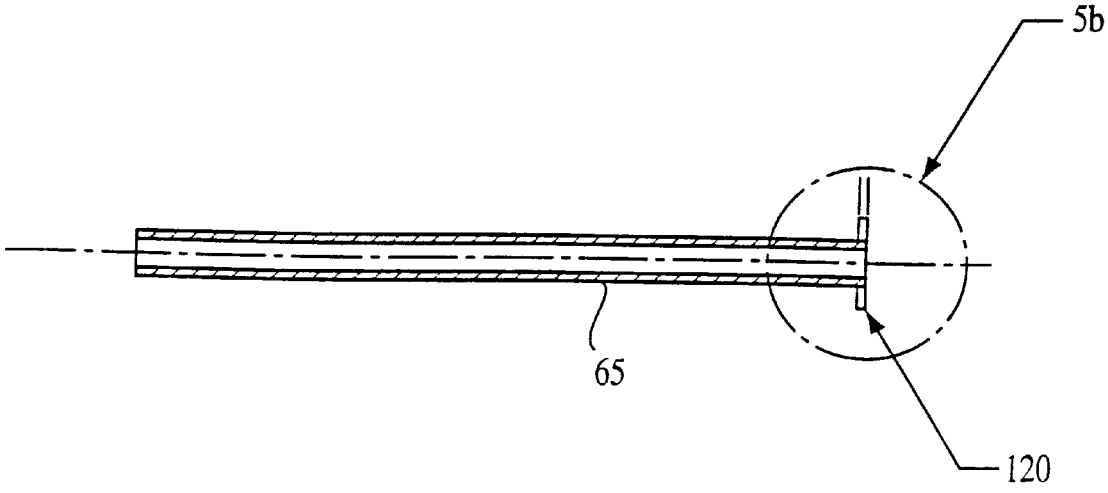
FIG. 10*a* is a cross-sectional view of a slurry delivery tube having a laser welded head.
Figure 10B:
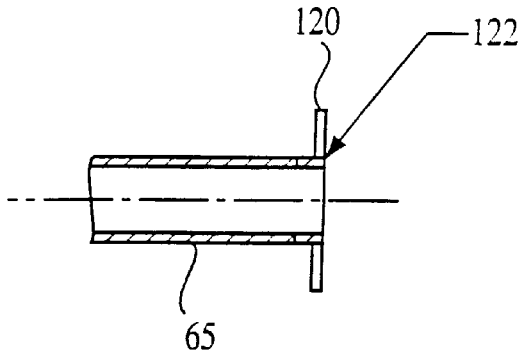
FIG. 10*b* is a close up view of a cross-section view of the laser welded head on the slurry delivery tube.

FIG. 10*a* shows a cross sectional view of a cylindrically shaped slurry delivery tube 65 that has an elongated channel. Slurry delivery tube 65 is made from type 316 stainless steel. At one end of tube 65 is a flange 120 that is laser welded onto one end of slurry delivery tube 65 as shown in FIG. 10*b*.

FIG. 11 shows a exploded side view of the lower platen assembly 2. During assembly, a urethane polishing pad 70 is attached to the bottom surface of Meehanite plate 60 via a sticky back adhesive so that holes 71, 72, and 73 are aligned with holes 66, 67, and 68 on Meehanite plate 60. Urethane pad 55 is then placed on a top surface of Meehanite plate 60 so that circumferential holes 56, 57 and 58 are aligned with holes 66, 67 and 68 on Meehanite plate 60. Then, slurry delivery tubes 65 are pushed through holes 56, 57, and 58 on pad 55 and fit snugly within circumferential holes 66, 67 and 68 on plate 60. In this way, these tubes 65 shield Meehanite plate from contact with the slurry and de-ionized water. In a preferred embodiment, there are 122 holes and delivery tubes disposed within platen 50. Flange 120 of each delivery tube 65 is seated on the surface of pad 55. Urethane plate 50 is then sealed to the top of pad 55 by screws 46 and 47 (FIG. 2) so that channels 52 become aligned with holes 57 58 and 59 on pad 55. Finally, hub 40 is placed inside of plate 50 so that channel 44 aligns with channel 52 in urethane plate 50.

Figure 12:
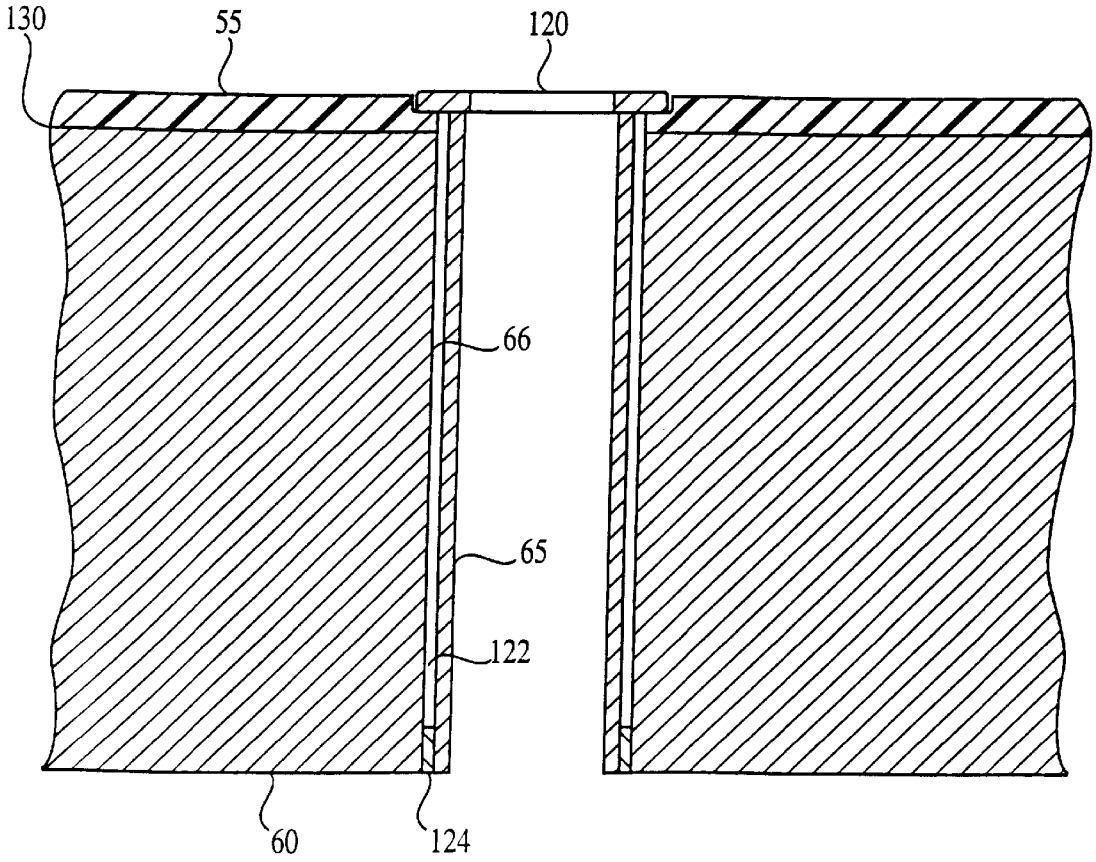
FIG. 12 shows a detailed cross-sectional view of the intersection between the slurry delivery tubes and the urethane pad.

FIG. 12 shows a detailed cross-sectional view of the taken through the platen 60 and one of the slurry distribution tubes 65. Flange 120, which has a thickness of about 0.013 inches, is pressed into pad 55, which has a thickness of about 0.060 inches, so that a top surface of flange 120 is flush against a top surface of pad 55. In addition, to keep this seal between flange 120 and pad 55 consistent, pad 55 is pressed onto Meehanite platen 60 with an adhesive backing 130 so that pad 55 remains sealed and fixed in position when the system is in use. Slurry distribution tubes 65 has a polished interior surface designed to allow slurry to travel through these tubes without catching or clogging the tubes. In addition, slurry distribution tubes 65 have a diameter of 0.12 inches and fit tightly inside platen holes 66, 67, and 68 which have a diameter of 0.125 inches. Any small gap 122 which is formed around tube 65 will fill up with slurry 124 that hardens and forms a a tight seal between tubes 65 and Meehanite platen 60.

After the components of the invention are assembled into the Wittig type polishing machines the combination of the slurry and de-ionized water is pumped under pressure through a rotary joint connected to the top of shaft 12 as shown in FIG. 2. The fluid is conducted down through tube 13 in shaft 12 to cross feed tube 20, through holes 41 and channels 44 of hub 40 and then is injected into radial channels 52 of plate 50. The pressurized slurry then travels circumferentially along circular channels 104, 106, and 108 over pad 55 and passes through delivery tubes 65 where it is fed onto the substrates to be polished.

With this design, it is possible to deliver slurry and deionized water in a uniform manner to the surface of the substrates being polished. In addition, since the corrosive slurry and de-ionized water flows through a series of passages made only from type 316 stainless steel and urethane, both inert to the slurry mixture, no oxides of iron (rust) will form within the polishing slurry media, which will produce unacceptable scratches on the nickel plated substrate surface. This design has produced yields of more than 97%, during the polishing operation, an increase of 10 to 15% above the prior art shown in FIG. 1.

Accordingly, while several embodiments of the present invention have been shown and described, it is to be understood that many changes and modifications may be made thereunto without departing from the spirit and scope of the invention as defined in the appended claims.

What is claimed is:

1. A slurry delivery system for use with a polishing machine having a hollow drive shaft, with its distal end connected to the top surface of a polishing platen having a plurality of holes for distributing a slurry containing de-ionized water to substrates to be polished comprising:

a) a longitudinally extending inner tube disposed within the drive shaft, said inner tube having a first end connected to a polishing slurry and a distal end disposed adjacent to the platen, said tube having reduced rust contamination properties;

b) a slurry distribution hub assembly mounted between the distal end of the drive shaft and the platen, and having a plurality of slurry distribution channels formed within;

c) means for coupling said hub assembly distribution channels to the distal end of said inner tube;

d) a non metallic plate disposed on the top surface of the platen and centered by the hub assembly, said plate having a plurality of slurry distribution channels coupled between said hub assembly and the platen;

e) a non-metallic slurry isolation pad disposed between said non-metallic plate and the platen and having a plurality of holes in alignment with the platen distribution holes;

f) a multitude of slurry distribution tubes inserted through said pad holes and into the distribution holes of the platen, over said non-metallic slurry isolation pad wherein said multitude of slurry distribution tubes and pad shielding the slurry and de-ionized water from contact with the platen so that when slurry which includes de-ionized water flows through said inner tube, through said channels of said slurry distribution hub assembly, through said non-metallic plate, it passes through said multitude of slurry distribution tubes mounted in the platen distributing holes and onto a plurality of substrates for polishing.

2. The slurry delivery system as claimed in claim 1, wherein said coupling means comprises a cross feed supply element attached to the distal end of the drive shaft, and at least one slurry supply tube having a first end coupled to said cross feed supply element and a second end coupled to said hub assembly, said cross feed supply element supplying slurry from said inner tube through said slurry supply tube to said hub assembly.

3. The slurry delivery system as claimed in claim 1, wherein said multitude of slurry distribution tubes are made from type 316 stainless steel.

4. The slurry delivery system as claimed in claim 1, wherein said multitude of slurry distribution tubes each have a flange attached to one end thereof wherein said flange is disposed in sealing contact with said slurry isolation pad.

5. The slurry delivery system as claimed in claim 4, wherein said flange is laser welded to each of said multitude of slurry distribution tubes.

6. The slurry delivery system as claimed in claim 1, wherein said slurry isolation pad is made from urethane.

7. The slurry delivery system as claimed in claim 1 wherein said non-metallic plate is constructed of urethane.

8. The slurry delivery system as claimed in claim 1, wherein said non-metallic plate comprises a plurality of spaced apart circumferential slurry carrying channels formed on its surface that is in contact with said isolation pad, and a plurality of radially spaced apart feed channels intersecting said circumferential channels wherein one end of said radial channels is coupled to said hub assembly distribution channels.

9. A slurry delivery system for use with a polishing machine having a hollow drive shaft, with its distal end connected to the top surface of a polishing platen having a plurality of holes for distributing a slurry containing de-ionized water to substrates to be polished comprising:

a) a longitudinally extending inner tube disposed within the drive shaft, said inner tube having a first end connected to a polishing slurry and a distal end disposed adjacent to the platen, said tube having reduced rust contamination properties;

b) a slurry distribution hub assembly mounted between the distal end of the drive shaft and the platen, and having a plurality of slurry distribution channels formed within;

c) a non metallic plate disposed on the top surface of the platen, said plate having a plurality of slurry distribution channels coupled between said inner tube and the platen;

d) means for coupling the distal end of said inner tube to the distribution channels of said non-metallic plate;

e) a non-metallic slurry isolation pad disposed between said non-metallic plate and the platen and having a plurality of holes in alignment with the platen distribution holes;

f) a multitude of slurry distribution tubes inserted through said pad holes and into the distribution holes of the platen, over said non-metallic slurry isolation pad wherein said multitude of slurry distribution tubes and pad shielding the slurry and de-ionized water from contact with the platen so that when slurry which includes de-ionized water flows through said inner tube, through said channels of said non-metallic plate, it passes through said multitude of slurry distribution tubes mounted in the platen distributing holes and onto a plurality of substrates for polishing.

10. The slurry delivery system as claimed in claim 9, wherein said coupling means comprises a cross feed supply element attached to the distal end of the drive shaft, and at least one slurry supply tube having a first end coupled to said cross feed supply element and a second end coupled to said non metallic plate, said cross feed supply element supplying slurry from said inner tube through said slurry supply tube to said non-metallic plate.

11. The slurry delivery system as claimed in claim 9, wherein said multitude of slurry distribution tubes are made from type 316 stainless steel.

12. The slurry delivery system as claimed in claim 9, wherein said multitude of slurry distribution tubes each have a flange attached to one end thereof wherein said flange is disposed in sealing contact with said slurry isolation pad.

13. The slurry delivery system as claimed in claim 2, wherein said flange is laser welded to each of said multitude of slurry distribution tubes.

14. The slurry delivery system as claimed in claim 9, wherein said slurry isolation pad is made from urethane.

15. The slurry delivery system as claimed in claim 9 wherein said non-metallic plate is constructed of urethane.

16. The slurry delivery system as claimed in claim 10, wherein said non-metallic plate comprises a plurality of spaced apart circumferential slurry carrying channels formed on its surface that is in contact with said isolation pad, and a plurality of radially spaced apart feed channels intersecting said circumferential channels wherein one end of said radial channels is coupled to said at least one slurry supply tube.

* * * * *